US010340643B2

(12) United States Patent
Imai et al.

(10) Patent No.: US 10,340,643 B2
(45) Date of Patent: Jul. 2, 2019

(54) CHARGING CONNECTOR

(71) Applicant: HORIZON CO., LTD., Kitaazumi-gun, Nagano (JP)

(72) Inventors: Kiyotaka Imai, Nagano (JP); Yasuhiro Imai, Nagano (JP); Sergii Leontiev, Nagano (JP)

(73) Assignee: HORIZON CO., LTD., Nagano (JP)

( * ) Notice: Subject to any disclaimer, the term of this patent is extended or adjusted under 35 U.S.C. 154(b) by 0 days.

(21) Appl. No.: 15/564,886

(22) PCT Filed: Aug. 18, 2016

(86) PCT No.: PCT/JP2016/074154

§ 371 (c)(1),
(2) Date: Oct. 6, 2017

(87) PCT Pub. No.: WO2017/145407

PCT Pub. Date: Aug. 31, 2017

(65) Prior Publication Data

US 2018/0366889 A1 Dec. 20, 2018

(30) Foreign Application Priority Data

Feb. 26, 2016 (JP) ..... 2016-000884

(51) Int. Cl.
*H01R 13/40* (2006.01)
*H01R 24/60* (2011.01)
(Continued)

(52) U.S. Cl.
CPC ..... *H01R 24/60* (2013.01); *H01R 4/023* (2013.01); *H01R 13/502* (2013.01);
(Continued)

(58) Field of Classification Search
CPC .... H01R 24/60; H01R 13/405; H01R 13/502; H01R 13/642; H01R 4/023
(Continued)

(56) References Cited

U.S. PATENT DOCUMENTS 5,170,322 A * 12/1992 von Guttenberg ... H01H 50/021 335/202
8,523,605 B2 9/2013 Kobayashi
(Continued)

FOREIGN PATENT DOCUMENTS

CN 101032056 A 9/2007
CN 102208783 A 10/2011
(Continued)

OTHER PUBLICATIONS

JP Notification of Reasons for Refusal corresponding to Application No. 2017-028413; dated Jan. 16, 2018.
(Continued)

*Primary Examiner* — Jean F Duverne
(74) *Attorney, Agent, or Firm* — Cantor Colburn LLP

(57) ABSTRACT

A charging connector comprising: a pair of power supply terminals for pinching power supply terminals of a Type-C plug connector complying with the USB connector standard from both sides, and a pair of grounding terminals and for pinching qrounding terminals of the plug connector from both sides; wherein the power supply terminals and the grounding terminals are configured by fork terminals.

8 Claims, 12 Drawing Sheets

(51) Int. Cl.

| | |
|---|---|
| ***H01R 4/02*** | (2006.01) |
| ***H01R 13/502*** | (2006.01) |
| *H01R 13/405* | (2006.01) |
| *H01R 13/642* | (2006.01) |
| *H01R 107/00* | (2006.01) |
| *H01R 12/72* | (2011.01) |
| *H01R 13/6594* | (2011.01) |

(52) U.S. Cl.
CPC ..... *H01R 12/722* (2013.01); *H01R 13/405* (2013.01); *H01R 13/642* (2013.01); *H01R 13/6594* (2013.01); *H01R 2107/00* (2013.01)

(58) Field of Classification Search
USPC ..... 439/600
See application file for complete search history.

(56) References Cited

U.S. PATENT DOCUMENTS

| | | | | |
|---|---|---|---|---|
| 9,627,826 | B2 * | 4/2017 | Wu | H01R 24/60 |
| 2003/0157836 | A1 | 8/2003 | Morikawa et al. | |
| 2008/0096399 | A1 | 4/2008 | Goh | |
| 2011/0244719 | A1 | 10/2011 | Xue et al. | |
| 2012/0052736 | A1 | 3/2012 | Fukushi | |
| 2012/0071016 | A1 | 3/2012 | Kobayashi | |
| 2013/0084752 | A1 | 4/2013 | Fukushi | |
| 2014/0004751 | A1 | 1/2014 | Fukushi | |
| 2016/0134056 | A1 | 5/2016 | Chen et al. | |
| 2016/0141817 | A1 | 5/2016 | Wu et al. | |
| 2016/0149347 | A1 | 5/2016 | Hsu et al. | |
| 2018/0108456 | A1 * | 4/2018 | Yin | H01B 11/125 |

FOREIGN PATENT DOCUMENTS

| | | | |
|---|---|---|---|
| CN | 102460840 | A | 5/2012 |
| CN | 104362450 | A | 2/2015 |
| CN | 204243263 | A | 4/2015 |
| JP | H03094019 | U | 9/1991 |
| JP | 2002191133 | A | 7/2002 |
| JP | 2003243093 | A | 8/2003 |
| JP | 2010272295 | A | 12/2010 |
| JP | 3198932 | U | 7/2015 |
| JP | 2017152381 | A | 8/2017 |
| TW | M505730 | U | 7/2015 |

OTHER PUBLICATIONS

International Search Report corresponding to Application No. PCT/JP2016/074154; dated Nov. 22, 2016.
SIPO First Office Action corresponding to CN Application No. 201680003202.9; dated Aug. 24, 2018.
JPO Notification of Reasons for Refusal corresponding to JP Application No. 2018-135270; dated Oct. 23, 2018.
JPO Notification of Reasons for Refusal corresponding to Application No. 2018-135270; dated Mar. 26, 2019.

* cited by examiner

CHARGING CONNECTOR

CROSS REFERENCE TO RELATED APPLICATIONS

This is a U.S. national stage of application No. PCT/JP2016/074154, filed on Aug. 18, 2016. Priority under 35 U.S.C. § 119(a) and 35 U.S.C. § 365(b) is claimed from Japanese utility model application for registration No. 2016-000884 filed on Feb. 26, 2016, the disclosure of which is also incorporated herein by reference.

TECHNICAL FIELD

The present invention relates to a charging connector.

BACKGROUND ART

As a new connector standard, "USB Type C" has been regulated as a future generation standard of USB (Universal Serial Bus). According to the "USB Type C" standard, a connector can supply power to apparatus connected thereto (see for example PTL 1) as a conventional USB connector can.

A conventional USB can supply the power of 5V, 1.5 A and 7.5 W in maximum while a Type-C connector can supply the power of 20V, 5 A and 100 W in maximum in maximum permissive increase in temperature of 30 deg. C.

Since a Type-C connector is required that twenty four terminals should be arranged in a space similar to that of a conventional micro USB connector with five terminals, it is highly integrated. In a Type-C connector, since terminals are inevitably made compact, each of a power supply circuit and a ground circuit can distribute electricity to four terminals as a common circuit.

CITATION LIST

Patent Literature

{PTL 1} JP 2002-191133 A

SUMMARY OF INVENTION

Technical Problem

In a Type-C connector, when each of a power supply circuit and a ground circuit distributes electric current to four terminals in a common circuit as described above, current passing through each terminal becomes fourth, that is, 1.25 A on each terminal at maximum current 5 A being supplied. In a known Type-C connector, since a common circuit is formed on a printed circuit board to have a small current capacity, it is likely to increase in temperature on power distribution.

Further, in a Type-C connector, terminal members are more compact than those of a conventional USB connector as described above and a stopper mechanism for attaching a plug connector to a jack connector is provided on the jack connector. Therefore, a Type-C connector must have a complex configuration so that it is difficult to lower the manufacturing cost.

A low-priced conventional USB connector, for example, is commercially available with reducing the number of terminals at a jack connector to provide a charging function only for an apparatus connected to be charged. On the other hand, since a Type-C connector requires a high accuracy process for arranging small terminal members on a circuit board, it is difficult to lower the manufacturing cost for such a Type-C connector even though the number of terminals are reduced for charging only. Further, since a Type-C connector requires a stopper mechanism on a jack connector even for charging, it is difficult to product a low-priced one with a charging function only.

The present invention is achieved under such a background to make a Type-C jack connector with a charging function only have a margin in current capacity and to provide a charging connector which can be produced in a low manufacturing cost.

Solution to Problem

A charging connector according to this invention comprised: a pair of power supply terminals for pinching power supply terminals of a Type-C plug connector complying with the USB connector standard from both sides, and a pair of grounding terminals and for pinching grounding terminals of the plug connector from both sides, for providing a charging function only; wherein the power supply terminals and the grounding terminals are configured by fork terminals.

In the charging connector described above, the fork terminals may be provided with cooling plates.

In the charging connector described above, a pair of the fork terminals may be connected by a cooling plate.

In the charging connector described above, each of the fork terminals may have larger volume than that of a Type-C standard terminal for pinching a power supply terminal or a grounding terminal of a plug connector from both sides.

In the charging connector described above, a soldering terminal may be provided on the cooling plate at opposite side of the fork terminal.

The charging connector described above may further comprise a base part the fork terminals assembled, and a reinforcing shell covering the base part; wherein stopper members complying with a stopper mechanism specified in the Type-C standard are assembled on both sides of the fork terminals in the base part.

In the charging connector described above, the stopper members may be provided with cutout portions respectively at externally extending portions from the base part for gripping a circuit board the charging connector to be connected.

In the charging connector described above, the base part may be provided with a insertion port for a plug connector specified in the Type-C standard, the opening area of the insertion port being smaller than that specified in the Type-C standard.

In the charging connector described above, the base part may comprise insulation members covering the power supply terminals and the grounding terminals partly, the length of parts of the grounding terminals not covered by the insulator members being different from the length of parts of the power supply terminals not covered by the insulator members.

The charging connector described above may further comprise a base part the fork terminals assembled, and a reinforcing shell covering the base part; wherein the base part is provided cutout portions for gripping a circuit board the charging connector to be connected, and the reinforcing shell is provided with stopper members, corresponding to a stopper mechanism complying with the Type-C standard, formed by parts of both side faces of the reinforcing shell folded inward.

Advantageous Effects of Invention

According to this invention, a Type-C jack connector with a charging function only can have a margin in current capacity and the manufacturing cost thereof can be lowered.

BRIEF DESCRIPTION OF DRAWINGS

(FIG. 12 to FIG. 14 show cross-sectional views along the center line in the lateral direction of the base part).

FIG. 13 is a diagram for comparing the state of insulation between the grounding terminals and the power supply terminals with the state in FIG. 12, showing a state in which a foreign object intrudes from the insertion port to short-circuit one of the grounding terminals and one of the power supply terminals.

FIG. 14 is a diagram showing a state when a foreign object adheres to one of the grounding terminals shown in FIG. 12.

DESCRIPTION OF EMBODIMENTS

A charging connector according to an embodiment of this invention will be described with referring FIG. 1 to FIG. 10.

[Brief Summary]

Figure 1:
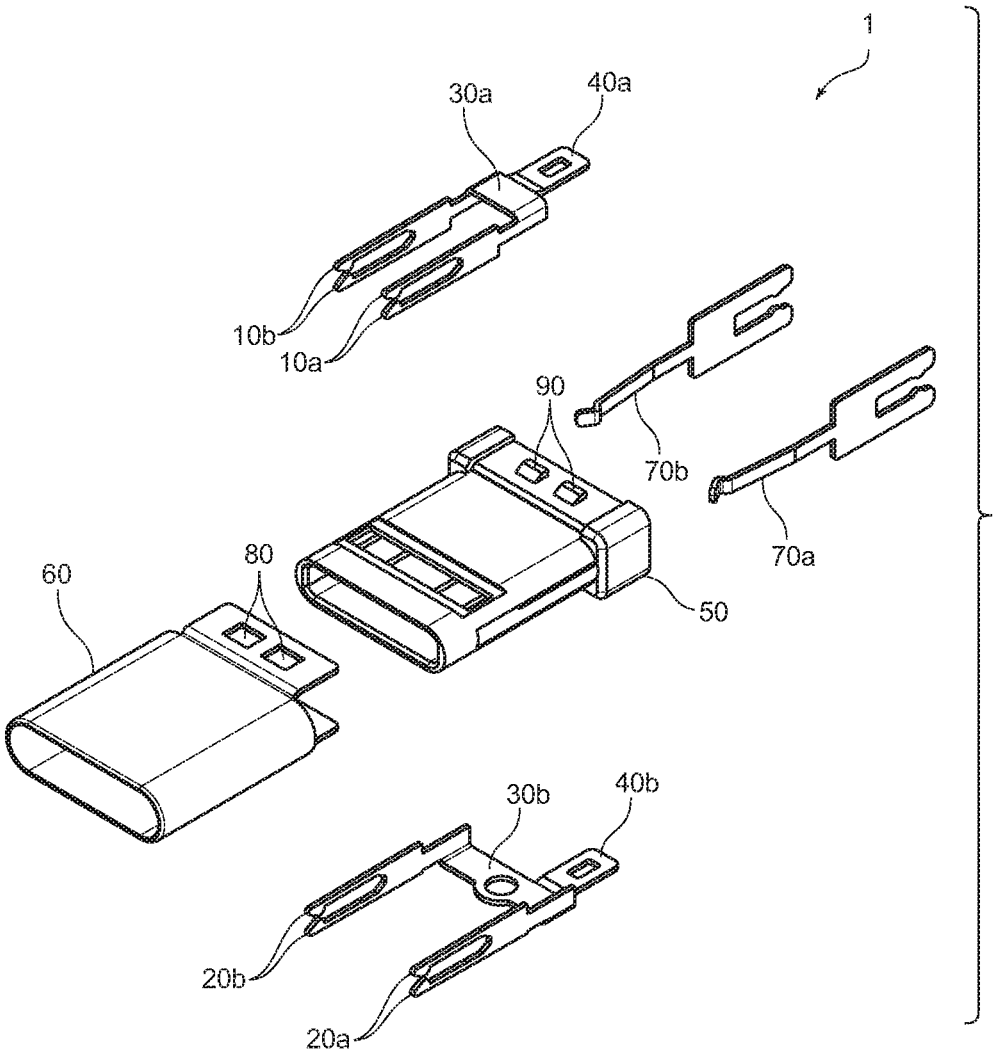
FIG. 1 is an exploded perspective view of a charging connector according to an embodiment of this invention.
Figure 2:
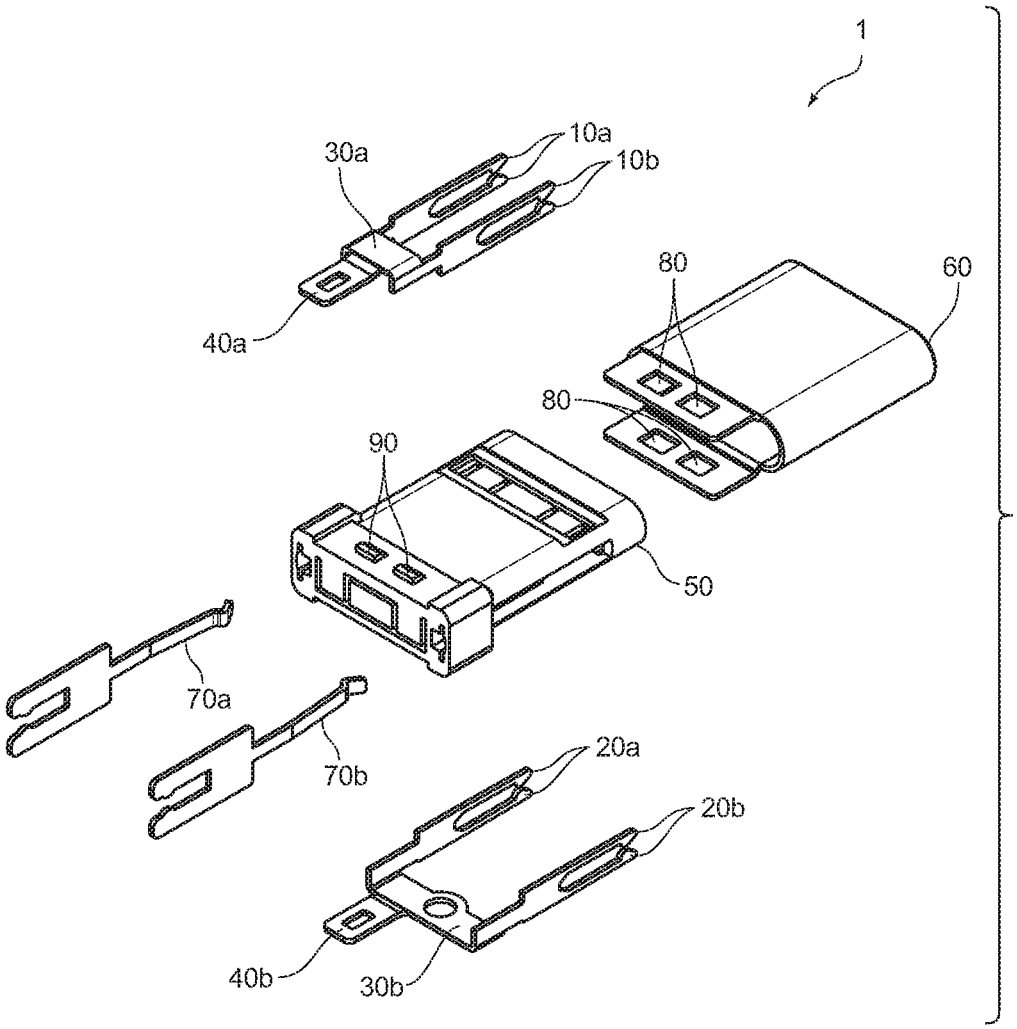
FIG. 2 is an exploded perspective view of the charging connector according to the embodiment of this invention as seen from the opposite side of FIG. 1.
Figure 3:
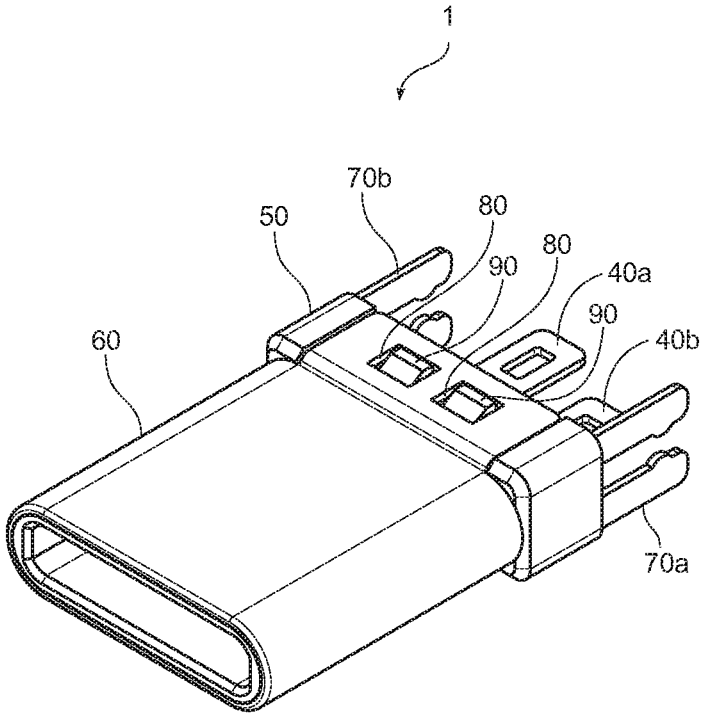
FIG. 3 is s a perspective view showing a state in which the charging connector of FIG. 1 is assembled.
Figure 4:
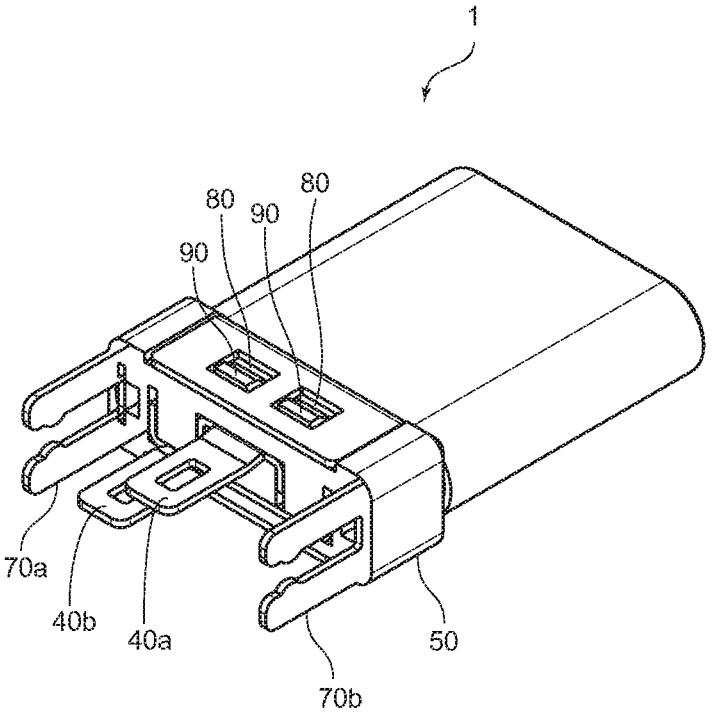
FIG. 4 is s a perspective view showing a state in which the charging connector of FIG. 2 is assembled.

A charging connector 1 according to the embodiment of this invention comprises, as shown in FIG. 1 to FIG. 2, a pair of power supply terminals 10*a* and 10*b* for pinching power supply terminals of a Type-C plug connector (not shown in the drawings) complying with the USB connector standard from both sides and a pair of grounding terminals 20*a* and 20*b* for pinching grounding terminals of the plug connector from both sides for providing a charging function only. Each of the power supply terminals 10*a*, 10*b* and the grounding terminals 20*a*, 20*b* is configured by a fork terminal. The power supply terminals 10*a*, 10*b* and the grounding terminals 20*a*, 20*b* as well as stopper members 70*a*, 70*b* described below are inserted into a base part 50 which is covered by a reinforcing shell 60. The reinforcing shell 60 is provided holes 80 such that the reinforcing shell 60 is fixed onto the base part 50 by putting protrusions 90 provided on the base part into the holes 80 respectively. FIG. 3 and FIG. 4 show the charging connector 1 assembled.

Figure 5:
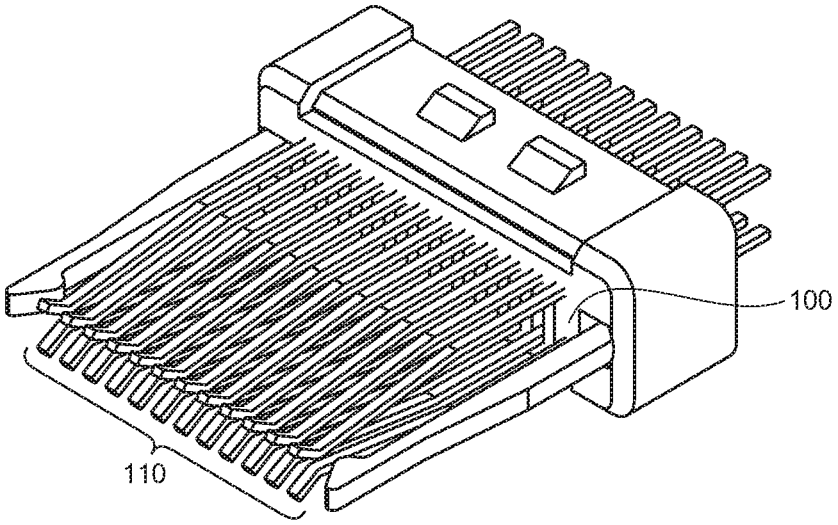
PRIOR ART Fig.5
FIG. 5 is a perspective view of an existing Type-C jack connector

FIG. 5 shows a perspective view of an existing Type-C jack connector. In the specifications of an existing Type-C connector, terminals for pinching plug connector side terminals from both sides are achieved by terminals 110 arranged on a supporting member 100. On the other hand, such terminals for pinching are achieved in the charging connector 1 by inserting the fork terminals into the base part 50. The power supply terminals 10*a*, 10*b* and the grounding terminals 20*a*, 20*b* are arranged symmetrically in respective pairs. According to such an arrangement, the charging connector 1 can be connected with a Type-C plug connector reversibly.

According to the charging connector 1 described above, current capacity can be made have a margin and also parts to be assembled and product process can be simplified to lower the manufacturing cost. In the following descriptions, essential members will be explained in their configurations and effects individually in detail.

[Power Supply Terminals 10*a*, 10*b* and Grounding Terminals 20*a*, 20*b*]

The power supply terminals 20*a* and 20*b* are, as shown in FIG. 1 and FIG. 2, mutually connected through a cooling plate 30*a* and the grounding terminals 10*a* and 10*b* are mutually connected through a cooling plate 30*b*. The cooling plate 30*a* and 30*b* are provided with soldering terminals 40*a* and 40*b* respectively. The soldering terminals 40*a* and 40*b* are not only to be used for connecting the charging connector 1 with conductors or electrical wires provided in a circuit board by soldering but also to contribute cooling effect as extended parts of the cooling plates 30*a* and 30*b* respectively.

Since the power supply terminals 10*a*, 10*b* and the grounding terminals 20*a*, 20*b* comprise, as described above, the cooling plate 30*a* and 30*b* and the soldering terminals 40*a* and 40*b* as extended parts of the cooling plate 30*a* and 30*b*, generation of heat can be suppressed at charging through the charging connector 1.

Each of the fork terminals forming the power supply terminals 10*a*, 10*b* and the grounding terminals 20*a*, 20*b* has larger volume than that of a Type-C standard terminal for pinching a power supply terminal or a grounding terminal of a plug connector. A metal plate forming each of the terminals 110 in the existing Type-C standard is 0.2 mm in thickness while a metal plate forming each of the power supply terminals 10*a*, 10*b*, the grounding terminals 20*a*, 20*b*, the cooling plate 30*a* and 30*b* and the soldering terminals 40*a*, 40*b* is, for example, 0.25 mm in thickness. Since the power supply terminals 10*a*, 10*b* and the grounding terminals 20*a*,

20*b* are larger in thermal capacity than the terminals 110 in the existing Type-C standard, the former can dissipate heat more than the latter.

[Stopper Members 70*a* and 70*b* as a Stopper Mechanism]

The charging connector 1 comprises, as shown in FIG. 1 to FIG. 4, stopper members 70*a* and 70*b* as a stopper mechanism specified in the Type-C standard. These stopper members 70*a* and 70*b* are formed by a metal plate thicker than a metal plate forming the reinforcing shell 60. For example, each of the stopper members 70*a* and 70*b* is formed by a metal plate 0.4 mm thick. The stopper members 70*a* and 70*b* ate inserted into sides of the base part 50 respectively. The stopper members 70*a* and 70*b* have depressed portions 71*a* and 71*b* respectively near their distal portions.

Figure 6:
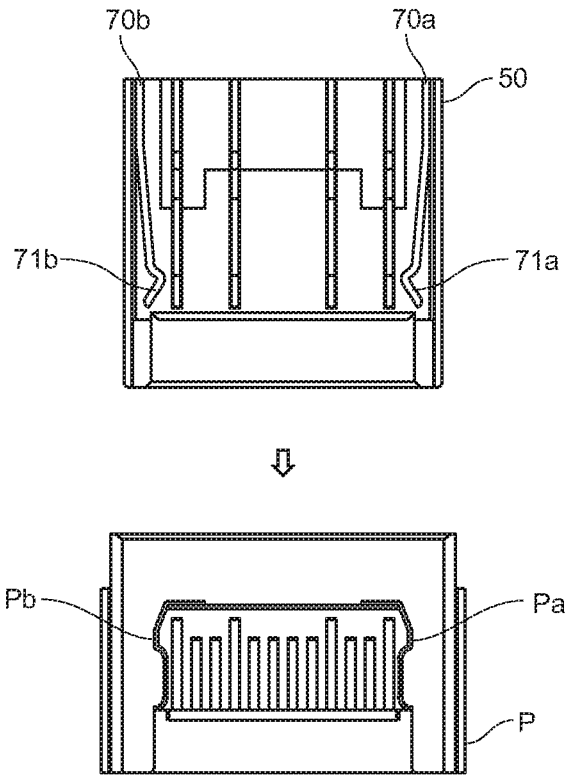
FIG. 6 is a view showing an arrangement state of the stopper members shown in FIG. 1 together with an arrangement state of convex portions of a plug connector.
Figure 7:
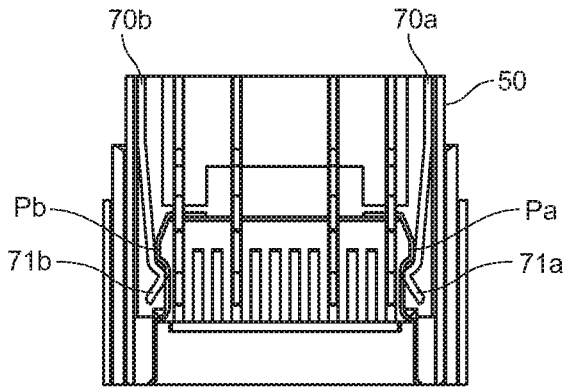
FIG. 7 is a view showing a state in which the recess of the stopper members shown in FIG. 6 is engaged with the projection of the plug connector.

The stopper members 70*a* and 70*b* inserted into the base part 50 are, as shown in FIG. 6, curved toward the inside of the base part 50 to have constant gaps between the inner walls of the base part 50 and the depressed portions 71*a* and 71*b* respectively. As shown in FIG. 7, when a Type-C plug connector is inserted into the base part 50, convex portions Pa and Pb of a plug connector P engage with the depressed portions 71*a* and 71*b* of the stopper members 70*a* and 70*b* respectively. In this manner, the charging connector 1 and the plug connector P are joined with a predetermined coupling forth.

Figure 8:
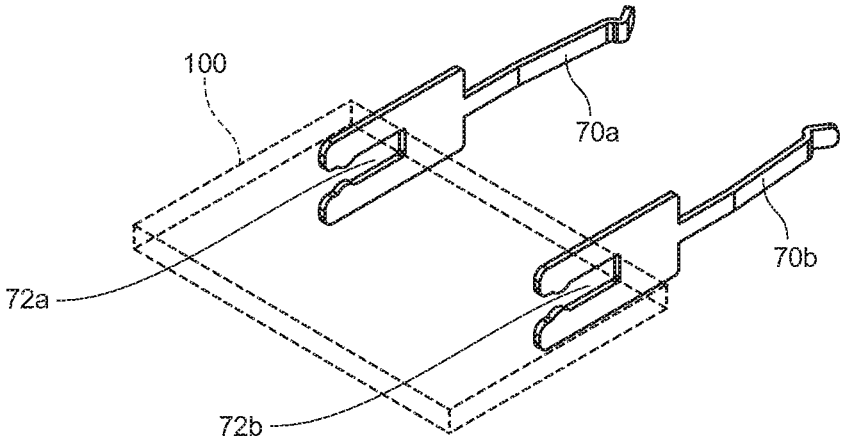
FIG. 8 is a view for explaining cutout portions provided on the stopper members shown in FIG. 1.
Figure 9:
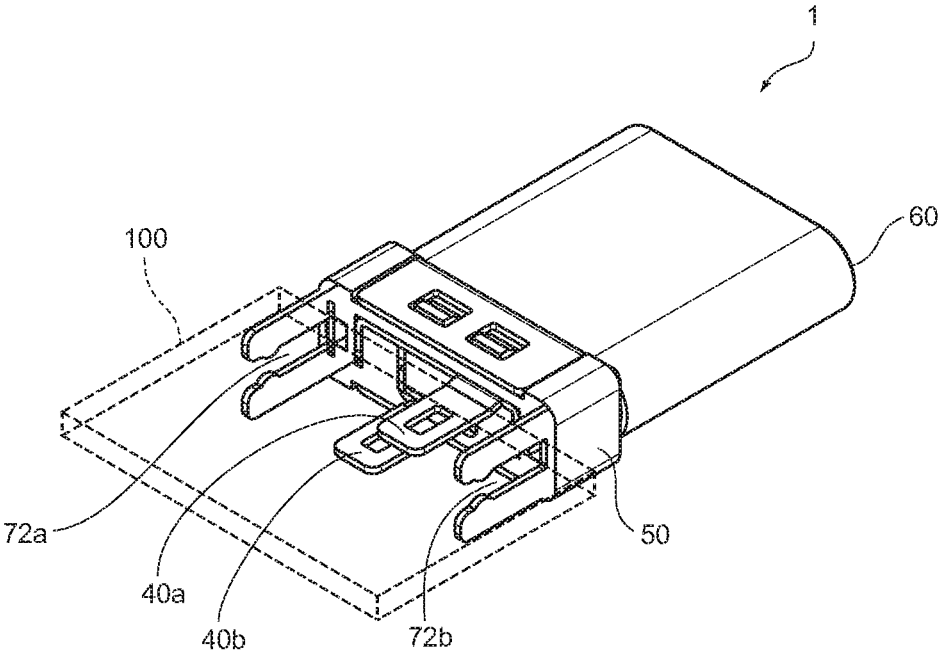
FIG. 9 is a view showing a state in which the charging connector is attached to a circuit board by the cutout portions shown in FIG. 8.

The stopper members 70*a* and 70*b* are provided, as shown in FIG. 8, with cutout portions 72*a* and 72*b* respectively at externally extending portions from the base part 50 for gripping the circuit board 100 to which the charging connector 1 is connected. In this manner, as shown in FIG. 9, the charging connector 1 can be attached to the circuit board 100 by means of the cutout portions 72*a* and 72. In this situation, the soldering terminals 40*a* is located at the upper side or power supply side of the circuit board 100 and the soldering terminal 40*b* is located at the lower side or grounding side of the circuit board 100.

As described above, the stopper members 70*a* and 70 b realize not only a stopper mechanism specified in the Type-C standard but also a mechanism for connecting the charging connector to the circuit board simultaneously. It can make the number of parts for assembling the charging connector and product man-hours be reduced to lower the manufacturing cost.

[Insertion Port 51]

Figure 10:
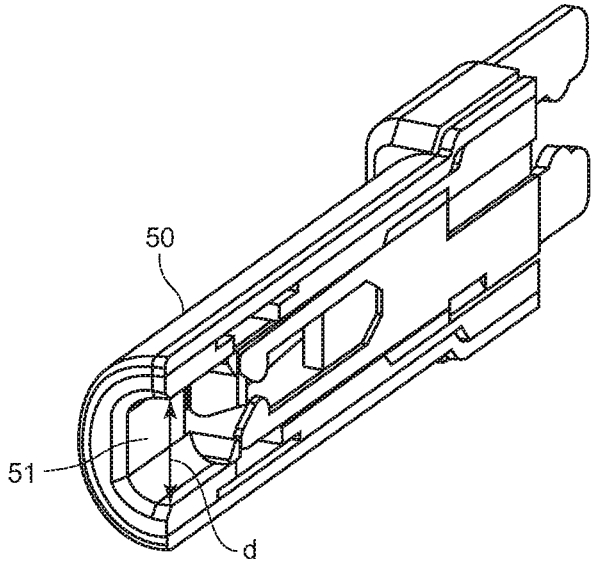
FIG. 10 is a cutaway perspective view showing a state of an insertion port into which a plug connector is inserted.
Figure 11:
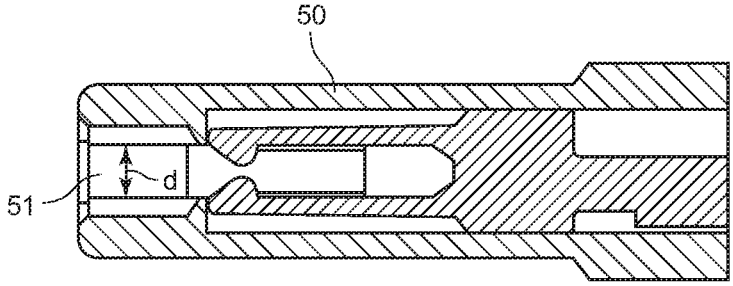
FIG. 11 is a view in which the cutaway part in the cutaway perspective view of FIG. 10 is replaced with a cross-sectional view.

The base part 50 is provided, as shown in FIG. 10 and FIG. 11, with a insertion port 51 for a plug connector specified in the Type-C standard. The opening area of the insertion port 51 is smaller than that specified in the Type-C standard. Specifically, the width in the shorter direction of the insertion port 51 is made approximately 30% narrower than that of the existing Type-C standard. It can make a gap between a plug connector inserted into the charging connector and the charging connector 1 to prevent a foreign object such as dirt or the like from intruding.

[Insulation Members 52*a*, 52*b* and 53 for Grounding Terminals 20*a*, 20*b* and Power Supply Terminals 10*a*, 10*b*]

Figure 12:
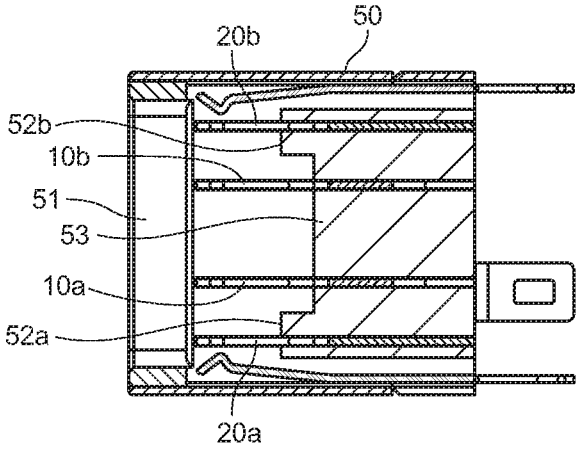
FIG. 12 is a diagram showing a state of insulation between the grounding terminals and the power supply terminals

The base part 50 comprises an insulation member 53 covering the power supply terminals 10*a* and 10*b* partly, and insulation members 52*a*, 52*b* covering the grounding terminals 20*a* and 20*b* partly. The grounding terminals 20*a* and 20*b* are, as shown in FIG. 12, not covered fully by the insulation members 52*a* and 52*b* of the base part 50. The power supply terminals 20*a* and 20*b* are, as shown in FIG. 12, not covered fully by the insulation member 53 of the base part 50. The insulator member 53 for the power supply terminals 10*a* and 10*b* is recessed from the insulation members 52*a* and 52*b* for the grounding terminals 20*a* and 20*b*. That is, the length of parts of the grounding terminals 20*a* and 20*b* not covered by the insulator members 52*a* and 52*b* in the base part 50 is different from the length of parts of the power supply terminals 10*a* and 10*b* not covered by the insulator member 53 in the base part 50.

Figure 13:
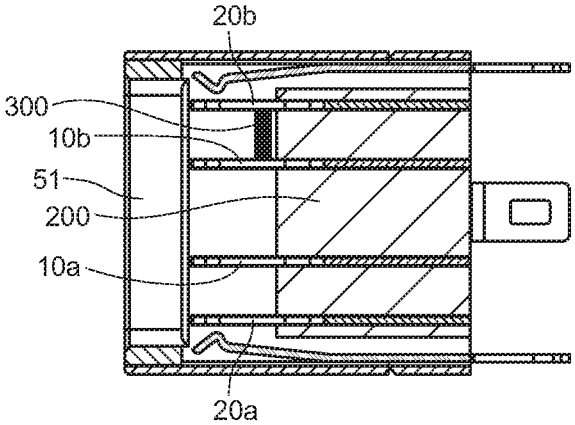
Figure 14:
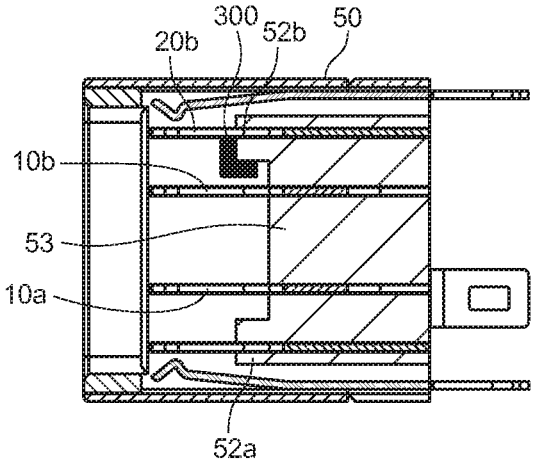

In a reference example shown in FIG. 13, the length of the parts of the grounding terminals 20*a* and 20*b* not covered by the insulator members 52*a* and 52*b* is same with that of the parts of the power supply terminals 10*a* and 10*b* not covered by the insulator member 53. In such a case, when extraneous material 300 enters from the insertion port 51 into the inside, it may cause a short circuit between the grounding terminal 20*b* and the power supply terminal 10*b*. On the other hand, by differentiating the length of the parts of the grounding terminals 20*a* and 20*b* not covered by the insulator members 52*a* and 52*b* from that of the parts of the power supply terminals 10*a* and 10*b* not covered by the insulator member 53, the extraneous material 300 may not cause a short circuit between the grounding terminal 20*b* and the power supply terminal 10*b*. Especially in the Type-C standard, since relatively large current as 5 mA (20V, 100 W) in maximum may flow, it is useful to arrange the power supply terminals 10*a*, 10*b* and the grounding terminals 20*a*, 20*b* to be prevented from shorting by the extraneous material 300 entering.

As described above, by differentiating the length of the parts of the grounding terminals 20*a* and 20*b* not covered by the insulator members 52*a* and 52*b* from that of the parts of the power supply terminals 10*a* and 10*b* not covered by the insulator member 53, it can be prevent the power supply terminals 10*a*, 10*b* and the grounding terminals 20*a*, 20*b* from shorting by the extraneous material 300 entering or the like.

[Other Embodiments]

The above mentioned embodiment may be arranged variously without deviating from the scope of this invention.

Figure 15:
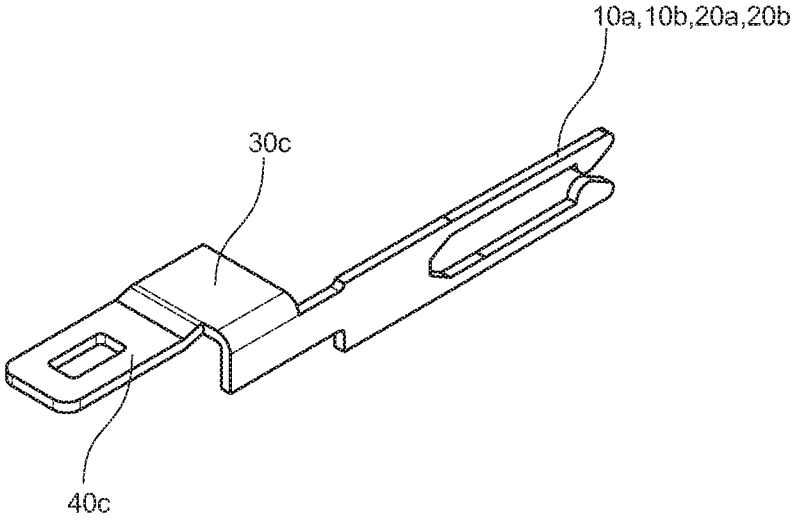
FIG. 15 is a view showing an individual fork terminal according to another embodiment together with a cooling plate and a soldering terminal.

For example, each of or any of the power supply terminals 10*a*, 10*b* or the grounding terminals 20*a*, 200*b* may be, as shown in FIG. 15, configured individually. Each of the individually formed power supply terminals 10*a*, 10*b* or grounding terminals 20*a*, 200*b* have a cooling plate 30*c* and a soldering terminals 40*c*.

By forming the power supply terminals 10*a*, 10*b* and the grounding terminals 20*a*, 20*b* individually as described above, for example, one kind of fork members may be used for configuring the power supply terminals 10*a*, 10*b* and the grounding terminals 20*a*, 20*b* to reduce the number of kinds of parts.

Figure 16:
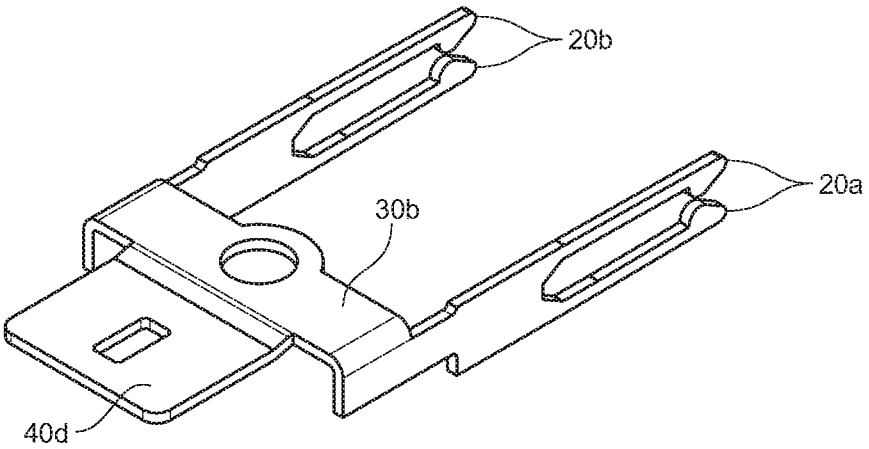
FIG. 16 is a view showing a soldering terminal of a grounding terminal according to another embodiment.
Figure 17:
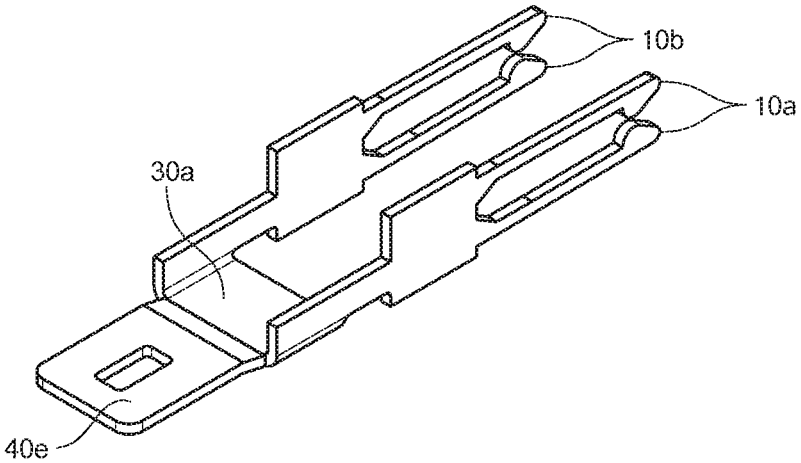
FIG. 17 is a view showing a soldering terminal of a power supply terminal according to another embodiment.

As shown in FIG. 16, the soldering terminal 40*d* of the ground circuit terminals 20*a*, 20*b* is wider than the soldering terminal 40*b* shown in FIG. 1. Similarly, as shown in FIG. 17, the soldering terminal 40*e* of the power supply terminals 10*a*, 10*b* is wider than the soldering terminal 40*a* shown in FIG. 1. In this manner, the width of the soldering terminal may be variously changed. The soldering terminal 40*d* of an individual fork terminal may also be changed in width variously. A hole provided at each of the soldering terminals 40*a*, 40*b*, 40*c*, 40*d* and 40*e* for making soldering easy may not be provided By appropriately changing the width of the soldering terminal and the presence or absence of the hole, the charging connector according to this invention can comply with various design standards.

Figure 18:
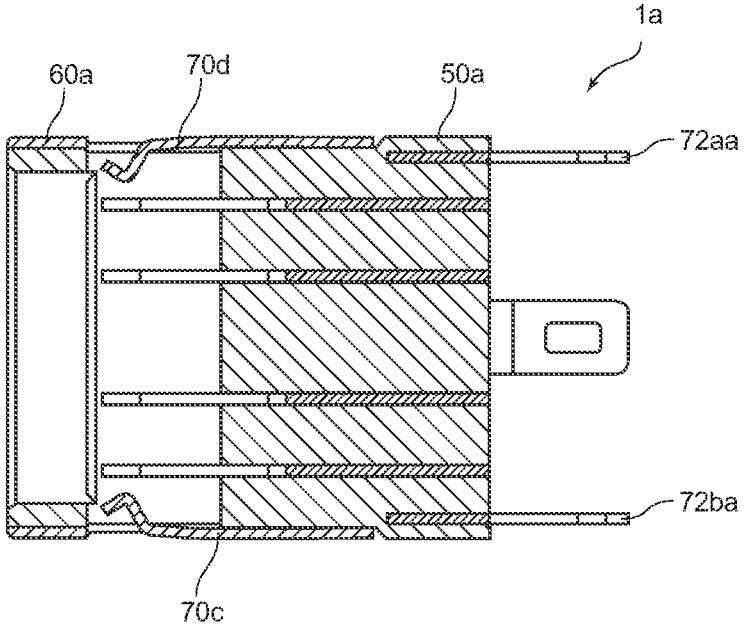
FIG. 18 is a cross-sectional view taken along the center line in the lateral direction of the base part and the reinforcing shell according to another embodiment.
Figure 19:
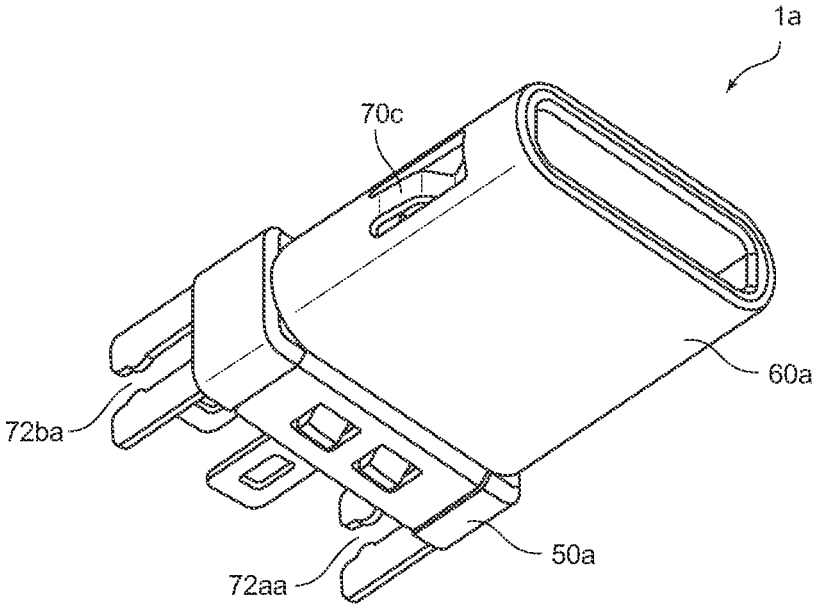
FIG. 19 is a perspective view of a charging connector having a base part and a reinforcing shell of FIG. 18.

As shown in FIG. 18 and FIG. 19, the base part 50*a* may be provided with cutout portions 72*aa* and 72*ba* for gripping the circuit board 100 to which the charging connector 1*a* is attached and the reinforcing shell 60*a* may comprise stopper members 70*c* and 70, corresponding to a stopper mechanism complying with the Type-C standard, formed by parts of both side faces of the reinforcing shell 60*a* folded inward.

As a result, the stopper members 70*a* and 70*b* cannot be provided and members of the cutout portions 72*aa* and 72*ba* can be simplified so that the manufacturing cost can be reduced.

In the embodiment described above, only the power supply circuit terminals 10*a*, 10*b* and the ground circuit terminals 20*a*, 20*b* are shown. However, in addition to these, it is possible to additionally provide terminals such as signal terminals. For example, in order to make the charging connector 1 chargeable even to a device having a connector of a standard other than Type-C (for example, Type-A, etc.), corresponding signal terminals may be added in accordance with the standard to enable to connect with a connector other than Type-C. According to this, the charging connector 1 can be made compatible with connectors of various standards.

[Effects According to the Embodiments of this Invention]

In this manner, the charging connector 1 can have a margin in the current capacity, the number of parts and the manufacturing process can be simplified, and the manufacturing cost can be reduced.

More specifically, in a conventional type-C connector, since the circuits of the connector pass through the circuit board, conducting cross-sectional areas of the circuits are small, surface areas for radiating heat are small, and heat capacities of the conductors are small. On the other hand, in the charging connector 1, fork terminals having larger volume than that of Type-C standard terminals are used for the power supply terminals 10*a*, 10*b* and the ground circuit terminals 20*a*, 20*b* so that the current capacity and heat capacity increase. For this reason, the amount of heat generated by the power supply terminals 10*a*, 10*b* and the grounding terminals 20*a*, 20*b* at the time of energization is small and the heat radiation amount is increased. Therefore, the temperature rise of the power supply terminals 10*a*, 10*b* and the grounding terminals 20*a*, 20*b* at the time of energization can be suppressed lower than in the prior art.

The soldering terminals 40*a* and 40*b* may be soldered not only to the circuit board but also to electric wires directly. In a conventional Type-C connector, it is impossible to directly solder terminals to electric wires directly. Since the charging connector is to have a charging function only, it is advantageous to solder the soldering terminals 40*a* and 40*b* directly to respective electric wires having large current capacities.

Further, for manufacturing the charging connector 1, a highly precise process for arranging a small terminal member on a circuit board is not required, and the stopper mechanism is also realized by a member having a simple shape. Therefore, the charging connector 1 can be manufactured at low cost.

The invention claimed is:

1. A charging connector comprising: a pair of power supply terminals for pinching power supply terminals of a Type-C plug connector complying with the USB connector standard from both sides, and a pair of grounding terminals for pinching grounding terminals of the plug connector from both sides; wherein the power supply terminals and the grounding terminals are configured by fork terminals;

the power supply terminals are mutually connected through a cooling plate which is provided with a soldering terminal at opposite side of the fork terminals;

the grounding terminals are mutually connected through a cooling plate which is provided with a soldering terminal at opposite side of the fork terminals;

one of the soldering terminals is located at an upper side of a circuit board to which the charging connector is to be connected; and the other of the soldering terminals is located at a lower side of the circuit board.

2. The charging connector according to claim 1, wherein each of the fork terminals has larger volume than that of a Type-C standard terminal for pinching a power supply terminal or a grounding terminal of a plug connector from both side.

3. The charging connector according to claim 2, wherein a soldering terminal is provided on the cooling plate at opposite side of the fork terminal.

4. The charging connector according to claim 1, further comprising a base part the fork terminals assembled, and a reinforcing shell covering the base part; wherein stopper members complying with a stopper mechanism specified in the Type-C standard are assembled on both sides of the fork terminals in the base part.

5. The charging connector according to claim 4, the stopper members are provided with cutout portions respectively at externally extending portions from the base part for gripping the circuit board to which the charging connector is to be connected.

6. The charging connector according to claim 4, wherein the base part is provided with a insertion port for a plug connector specified in the Type-C standard, the opening area of the insertion port being smaller than that specified in the Type-C standard.

7. The charging connector according to claim 4, wherein the base part comprises insulation members covering the power supply terminals and the grounding terminals partly, the length of parts of the grounding terminals not covered by the insulator members being different from the length of parts of the power supply terminals not covered by the insulator members.

8. The charging connector according to claim 1, further comprising a base part the fork terminals assembled, and a reinforcing shell covering the base part; wherein the base part is provided cutout portions for gripping a circuit board the charging connector to be connected, and the reinforcing shell is provided with stopper members, corresponding to a stopper mechanism complying with the Type-C standard, formed by parts of both side faces of the reinforcing shell folded inward.

* * * * *